US006786851B1

(12) United States Patent
Maresh

(10) Patent No.: US 6,786,851 B1
(45) Date of Patent: Sep. 7, 2004

(54) EXERCISE APPARATUS WITH ELLIPTICAL STEPPING MOTION

(76) Inventor: Joseph D. Maresh, P.O. Box 645, West Linn, OR (US) 97068-0645

( * ) Notice: Subject to any disclaimer, the term of this patent is extended or adjusted under 35 U.S.C. 154(b) by 138 days.

(21) Appl. No.: 10/066,029

(22) Filed: Jan. 31, 2002

Related U.S. Application Data

(62) Division of application No. 09/065,308, filed on Apr. 23, 1998.

(60) Provisional application No. 60/044,957, filed on Apr. 26, 1997.

(51) Int. Cl.[7] ..... A63B 69/16; A63B 22/04

(52) U.S. Cl. ..... 482/52; 482/57

(58) Field of Search ..... 482/51, 52, 53, 482/57, 70, 79, 80

(56) References Cited

U.S. PATENT DOCUMENTS

| | | | | | |
|---|---|---|---|---|---|
| 5,759,136 | A | * | 6/1998 | Chen | 482/57 |
| 5,762,588 | A | * | 6/1998 | Chen | 482/57 |
| 5,779,599 | A | * | 7/1998 | Chen | 482/57 |
| 6,045,487 | A | * | 4/2000 | Miller | 482/52 |
| 6,217,486 | B1 | * | 4/2001 | Rosenow | 482/52 |

* cited by examiner

*Primary Examiner*—Stephen R. Crow

(57) ABSTRACT

An exercise apparatus includes left and right rigid connector links having first portions rotatably connected to respective cranks, second portions constrained to move in reciprocating fashion, and third portions connected to respective foot supports. Also, floating cranks are rotatably interconnected between respective cranks and respective foot supports. The resulting assembly links rotation of the cranks to movement of the foot supports through generally elliptical stepping paths. The connection points may be moved relative to one another and/or a supporting frame to adjust the size, shape, and/or orientation of the paths.

8 Claims, 2 Drawing Sheets

EXERCISE APPARATUS WITH ELLIPTICAL STEPPING MOTION

CROSS-REFERENCE TO RELATED APPLICATIONS

This is a divisional of U.S. patent application Ser. No. 09/065,308, filed on Apr. 23, 1998, which in turn, discloses subject matter entitled to the filing date of U.S. Provisional Application Serial No. 60/044,957, filed on Apr. 26, 1997.

FIELD OF THE INVENTION

The present invention relates to exercise methods and apparatus and more particularly, to exercise equipment that facilitates a generally elliptical stepping motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate elliptical exercise motion. An object of the present invention is to provide an elliptical exercise machine that generates a favorable elliptical foot path.

SUMMARY OF THE INVENTION

The present invention may be described in terms of a novel linkage assembly and corresponding exercise apparatus suitable for generating a generally elliptical stepping motion. On each side of a preferred embodiment, a first portion of a connector link is pivotally connected to a crank; a second portion of the connector link is pivotally connected to a rocker link; and a third portion of the connector link is pivotally connected to a foot support. Also, a floating crank is pivotally interconnected between the foot support and the crank. As the cranks rotate, the linkage assembly constrains the foot supports to travel through a generally elliptical path having a relatively vertical orientation. Additional features and/or advantages of the present invention may become more apparent from the more detailed description set forth below.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
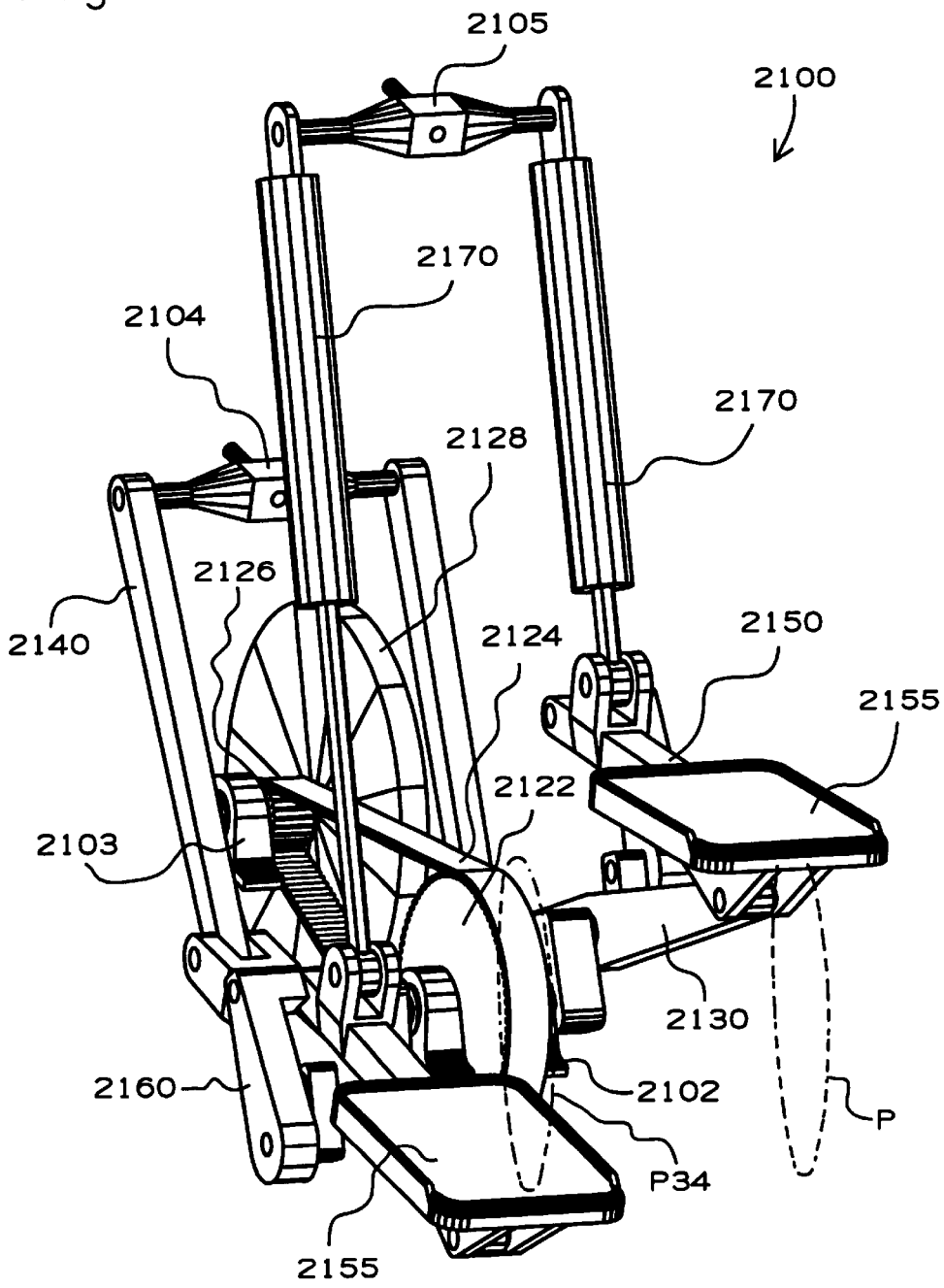
FIG. 1 is a perspective view of a preferred embodiment exercise apparatus constructed according to the principles of the present invention.
Figure 2:
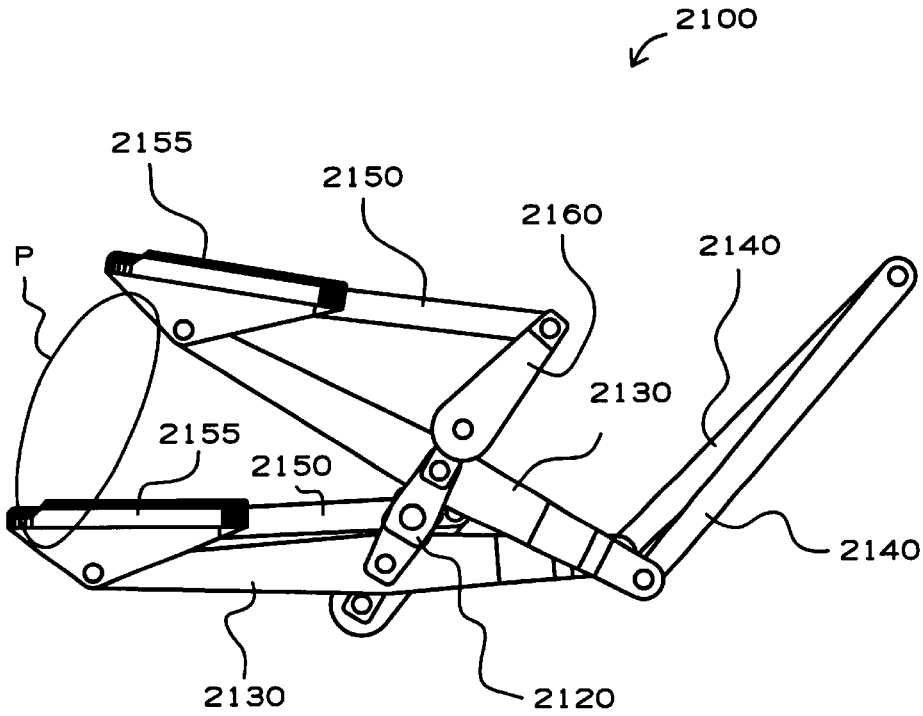
FIG. 2 is a side view of a portion of the apparatus of FIG. 1.

FIGS. 1–2 show a "stepping" type exerciser 2100 constructed according to the principles of the present invention. The exercise apparatus 2100 includes left and right cranks 2120 rotatably connected to a frame by means of a crank shaft and bearing assemblies 2102. A larger diameter pulley 2122 is keyed to the crank shaft and rotates together with the cranks 2120 about a common crank axis. A belt 2124 connects the pulley 2122 to a smaller diameter pulley 2126 which is rigidly secured to a flywheel 2128. The pulley 2126 and the flywheel 2128 are rotatably connected to the frame by means of a flywheel shaft and bearing assemblies 2103. As a result, the pulley 2126 and the flywheel 2128 rotate at a relative faster rotational velocity than the cranks 2120 and pulley 2122. A conventional resistance device may be connected to the flywheel 2128 to resist rotation thereof.

Left and right connector links 2130 have intermediate portions which are rotatably connected to radially displaced portions of respective cranks 2120. The connector links 2130 have first ends which are rotatably connected to first ends of respective rocker links 2140, and second, opposite ends which are connected to respective foot supporting members 2150. The rocker links 2140 have second, opposite ends which are rotatably connected to the frame by means of frame member 2104.

One end of each foot supporting member 2150 is rotatably connected to a respective connector link 2130, and an opposite end of each foot supporting member 2150 is rotatably connected to an end of a respective floating crank 2160. An opposite end of each floating crank 2160 is rotatably connected to a distal end of a respective crank 2120. Left and right foot platforms 2155 are mounted on respective foot supporting members 2150 proximate their pivotal connections with respective connector links 2130. The floating cranks 2160 and pivoting foot supporting members 2150 cooperate to maintain the foot platforms 2155 in relatively favorable orientations throughout an exercise cycle.

Optional left and right dampers 2170 are rotatably interconnected between frame member 2105 and intermediate portions of respective foot supporting members 2150. The arrangement is such that the dampers 2170 tend to resist vertical movement of the foot platforms 2155 without unduly interfering with "over center" rotation of the cranks 2120.

The foregoing disclosure focuses on a preferred embodiment and a particular application with the understanding that persons skilled in the art will be able to derive additional embodiments, modifications, and/or features that nonetheless fall within the scope of the present invention. For example, modifications may be made to the size, configuration, and/or arrangement of the linkage assembly components as a matter of design choice, and/or portions thereof may be replaced with mechanical equivalents. Also, the configuration of the exercise motion may be adjusted by changing the distance between the frame members, and/or by changing the length of one or more of the linkage assembly components. Furthermore, the linkage assembly may be configured to accommodate a user facing either direction while standing on the foot platforms. With the foregoing in mind, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on said frame;

a left guide and a right guide, wherein each said guide is mounted on the frame for movement in oscillatory fashion relative thereto;

a left connector link and a right connector link, wherein each said connector link has a first portion movably connected to a respective crank and a second portion movably connected to a respective guide;

a left foot supporting link and a right foot supporting link, wherein each said foot supporting link has a first end linked to a respective connector link and a second end linked to a respective crank in a manner that links crank rotation to foot movement through adjacent, generally elliptical paths having a horizontal component and a relatively greater vertical component;

a left floating crank is pivotally interconnected between the left foot supporting link and the left crank, and a right floating crank is pivotally interconnected between the right foot supporting link and the right crank.

2. The exercise apparatus of claim 1, wherein each said guide is a rocker link pivotally mounted on the frame at a common pivot axis.

3. An exercise apparatus, comprising:

a frame designed to rest upon a floor surface;

a left crank and a right crank, wherein each said crank is rotatably mounted on said frame;

a left foot supporting link and a right foot supporting link;

a left connector link and a right connector link, wherein each said connector link has one end constrained to move in oscillatory fashion relative to the frame, an intermediate portion pivotally connected to a respective crank, and an opposite end pivotally connected to a first end of a respective foot supporting link in a manner that constrains the first end to move through a generally elliptical path having a horizontal component and a relatively greater vertical component;

a left linking means and a right linking means, each for linking a respective crank to an opposite, second end of a respective foot supporting link in a manner that limits angular displacement of the foot supporting link as the cranks rotate and each said linking means includes a floating crank pivotally interconnected between a respective crank and a respective foot supporting link.

4. The stepping machine of claim 3, wherein a left rocker link is pivotally interconnected between the frame and the one end of the left connector link, and a right rocker link is pivotally interconnected between the frame and the one end of the right connector link.

5. An exercise apparatus, comprising:

a frame designed to rest upon a floor surface;

a left crank and a right crank, wherein each said crank is rotatably mounted on said frame at a common crank axis;

a left rocker link and a right rocker link, wherein each said rocker link is pivotally connected to the frame at a common pivot axis;

a left foot supporting link and a right foot supporting link;

a left connector link and a right connector link, wherein each said connector link is rotatably connected to a respective crank, a respective rocker link, and a respective foot supporting link; and a left floating crank and a right floating crank, wherein each said floating crank is pivotally interconnected between a respective foot supporting link and a respective crank.

6. The exercise apparatus of claim 5, wherein each said foot supporting link is connected to a first end of a respective connector link, and each said rocker link is connected to an opposite, second end of a respective connector link, and each said crank is connected to an intermediate portion of a respective connector link.

7. The exercise apparatus of claim 6, wherein each said connector link is connected to a first end of a respective foot supporting link, and each said floating crank is connected to an opposite, second end of a respective foot supporting link.

8. The exercise apparatus of claim 7, wherein a left foot platform is mounted on the first end of the left foot supporting link, and a right foot platform is mounted on the first end of the right foot supporting link.

* * * * *